United States Patent [19]

St. Aubin

[11] 4,411,104

[45] Oct. 25, 1983

[54] INSWING DOOR BOTTOM AND SILL ASSEMBLY

[75] Inventor: William R. St. Aubin, Wood, Ohio

[73] Assignee: LST Corporation, Sylvania, Ohio

[21] Appl. No.: 454,737

[22] Filed: Dec. 30, 1982

Related U.S. Application Data

[63] Continuation of Ser. No. 205,914, Nov. 12, 1980, abandoned.

[51] Int. Cl.[3] ..... E06B 1/70

[52] U.S. Cl. ..... 49/470; 49/467

[58] Field of Search ..... 49/467–471

[56] References Cited

U.S. PATENT DOCUMENTS

| | | | |
|---|---|---|---|
| 502,644 | 6/1918 | Vallandingham . | |
| 1,563,409 | 10/1927 | Walker . | |
| 1,936,641 | 11/1933 | Plym . | |
| 2,739,357 | 3/1956 | Seabrook . | |
| 2,976,584 | 3/1961 | Ghormley . | |
| 3,346,994 | 10/1967 | Kesler . | |
| 3,402,512 | 9/1968 | Peterson . | |
| 3,448,543 | 6/1969 | Multer | 49/470 |
| 3,521,404 | 7/1970 | Hager et al. | 49/469 X |
| 3,774,343 | 11/1973 | Cribben et al. | 49/467 |
| 3,851,420 | 12/1974 | Tibbits . | |
| 3,854,246 | 12/1974 | McAllister | 49/470 |
| 3,900,967 | 8/1975 | Bursk et al. . | |
| 4,122,632 | 10/1978 | Dixon | 49/470 |
| 4,185,417 | 1/1980 | McKann | 49/470 |

FOREIGN PATENT DOCUMENTS

| | | |
|---|---|---|
| 1062183 | of 0000 | United Kingdom . |
| 1124506 | of 0000 | United Kingdom . |
| 1493279 | of 0000 | United Kingdom . |

*Primary Examiner*—Philip C. Kannan

*Attorney, Agent, or Firm*—Emch, Schaffer & Schaub Co.

[57] ABSTRACT

An improved door bottom and sill assembly for inswing exterior doors is disclosed. The door bottom and sill assembly consists of a bottom portion and a sill portion. The bottom portion has a sealing member along the interior bottom edge of the door. The sill portion mates with the sealing member when the door is in a closed position, forming a tight weather barrier.

10 Claims, 7 Drawing Figures

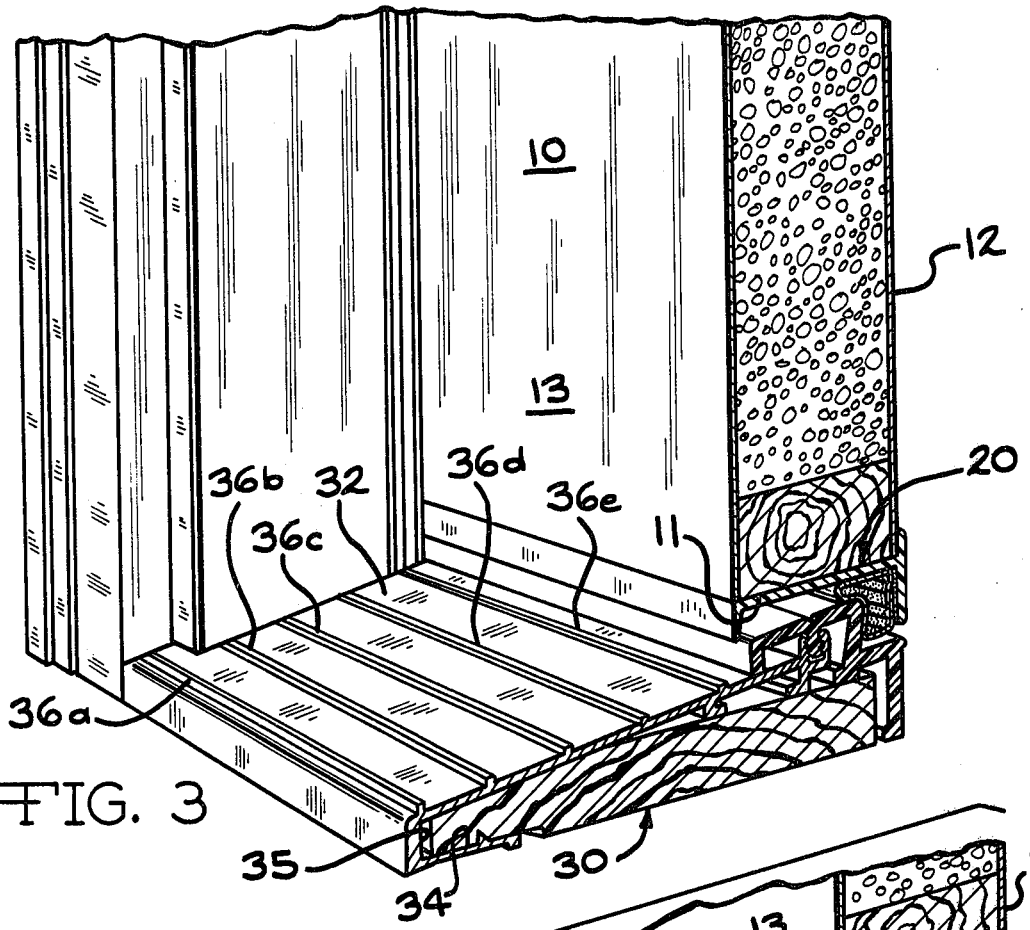
FIG. 3
FIG. 4
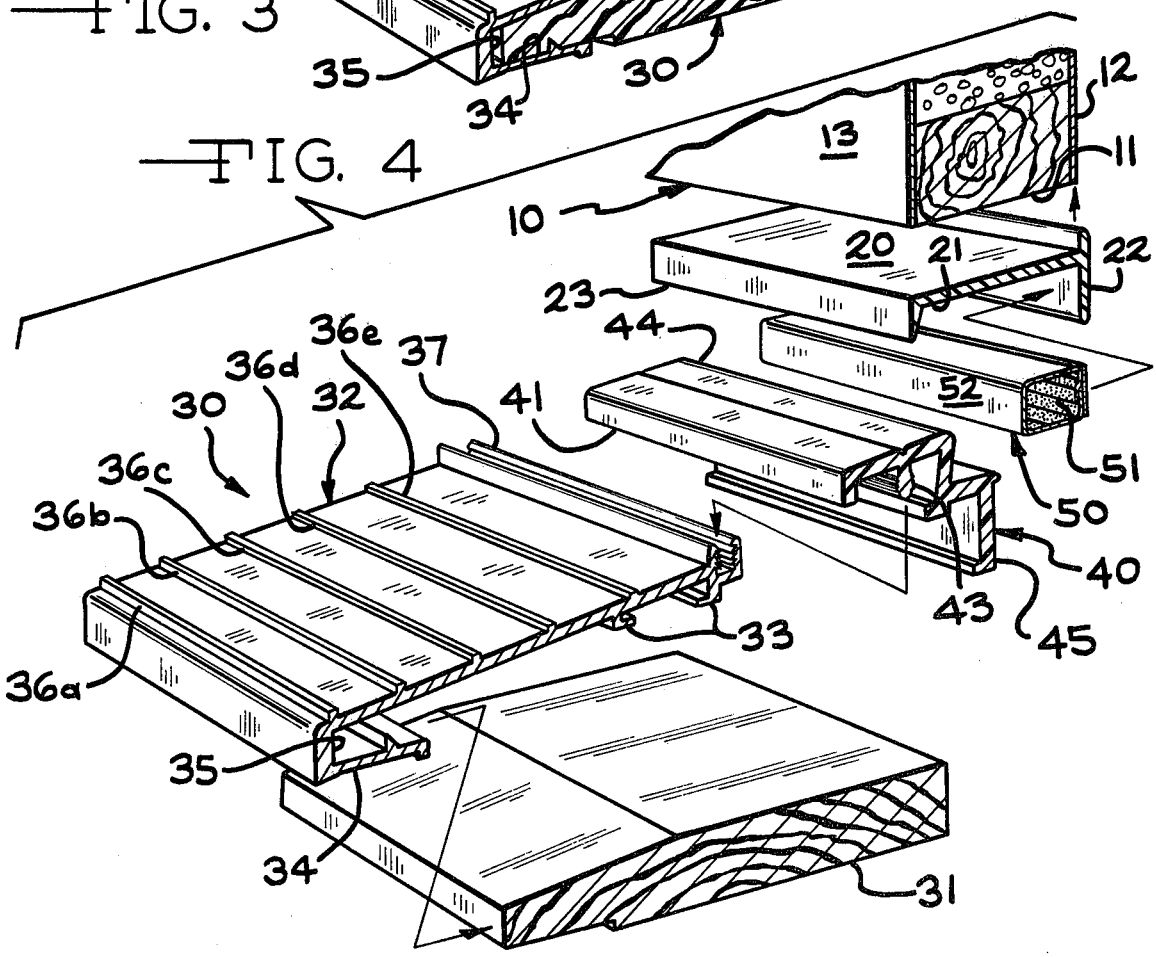

INSWING DOOR BOTTOM AND SILL ASSEMBLY

This is a continuation of application Ser. No. 205,914 filed Nov. 12, 1980, now abandoned.

BACKGROUND OF THE INVENTION

The instant invention discloses an improved door bottom and sill assembly for exterior doors. It is common for exterior doors to lose their weather seals, causing areas of wind and water leakage and failure to prevent such unwanted elements from passing through the barrier.

The instant invention eliminates many of the disadvantages of prior art assemblies and is particularly useful in connection with inswing doors.

Some prior art inswing door assemblies include a barrier mounted between the sill and the bottom of the door. This type of prior art assembly must have a precise mate along the entire door bottom to insure a total seal.

The present door bottom and sill assembly does not need a precise height adjustment between the bottom of the door and the sill to maintain its sealing capabilities, as is required with any prior art interlock system.

Further advantages of the instant invention will become obvious upon review of the drawings and the following descriptions thereof.

BRIEF DESCRIPTION OF THE DRAWINGS

FIG. 3 is a perspective fragmentary view of an alternative embodiment of the present invention;

FIG. 4 is a fragmentary exploded view of the various elements of the alternate embodiment of the door bottom and sill assembly shown in FIG. 3.

DETAILED DESCRIPTION OF THE DRAWINGS

Figure 1:
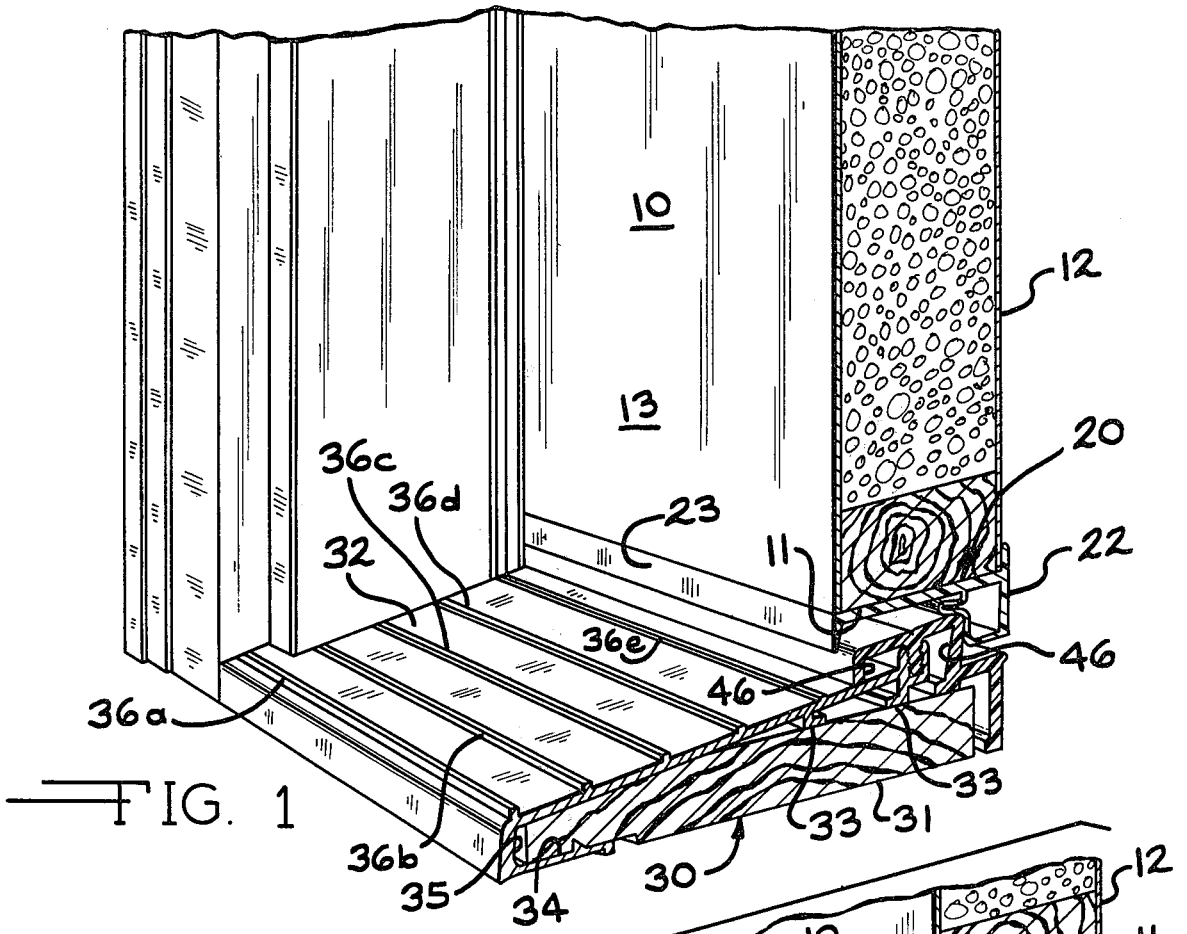
FIG. 1 is a fragmentary perspective view of the door bottom and sill assembly constructed in accordance with the present invention.

The door bottom and sill assembly of the present invention is composed of two units which fit into a mating relationship with each other when, for example, an exterior inswing door 10 is closed, thereby causing a tight weather-impervious seal. A bottom assembly portion 20 is mounted on the bottom 11 of the exterior door 10. The bottom assembly 20 may be integrally constructed, having a flat base 21 which is substantially the same shape and area as the bottom 11 of the door 10. A substantially vertical side 22 extends downwardly from the inside edge of the base 21 and extends along the interior side 12 of the door 10. A lip 23 extends downwardly from the exterior edge of the base 21 adjacent the exterior side 13 of the door. The lip 23 provides improved appearance for the exterior side 13 of the door 10 and serves to direct water downwardly.

A sealing member 24 is located below the base 21 adjacent the vertical side 22. In one preferred embodiment, shown in FIGS. 1 and 2, the sealing member 24 is of a hollow cross-section with a flexible exterior side 25 being angularly disposed between perpendicular sides defined by the base 21 and the sides 22. The sealing member 24 having a central air space 26 is constructed of a flexible material, thereby allowing for deflection when the door 10 is closed to form a tight seal. The bottom assembly 20, including the lip 23 and the hollow sealing member 24 may be constructed of various types of flexible materials, such as vinyls, polyolefins, modified polyolefins or synthetic rubber blends.

Figure 7:
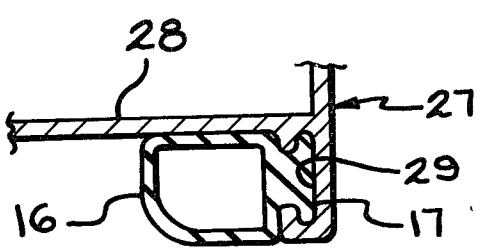
FIG. 7 is a cross sectional view of another embodiment of a sealing member assembly.

Another embodiment of a sealing member assembly is shown in FIG. 7 and indicated by the reference number 27. The assembly 27 includes a support member 28 which defines a "T" shaped recess 29. A removable bumper or sealing member 16 has a hollow cross-section and a base portion 17 which mates with the recess 29 of the support member 28. The sealing member 16 is, therefore, easily removed and replaced.

Figure 2:
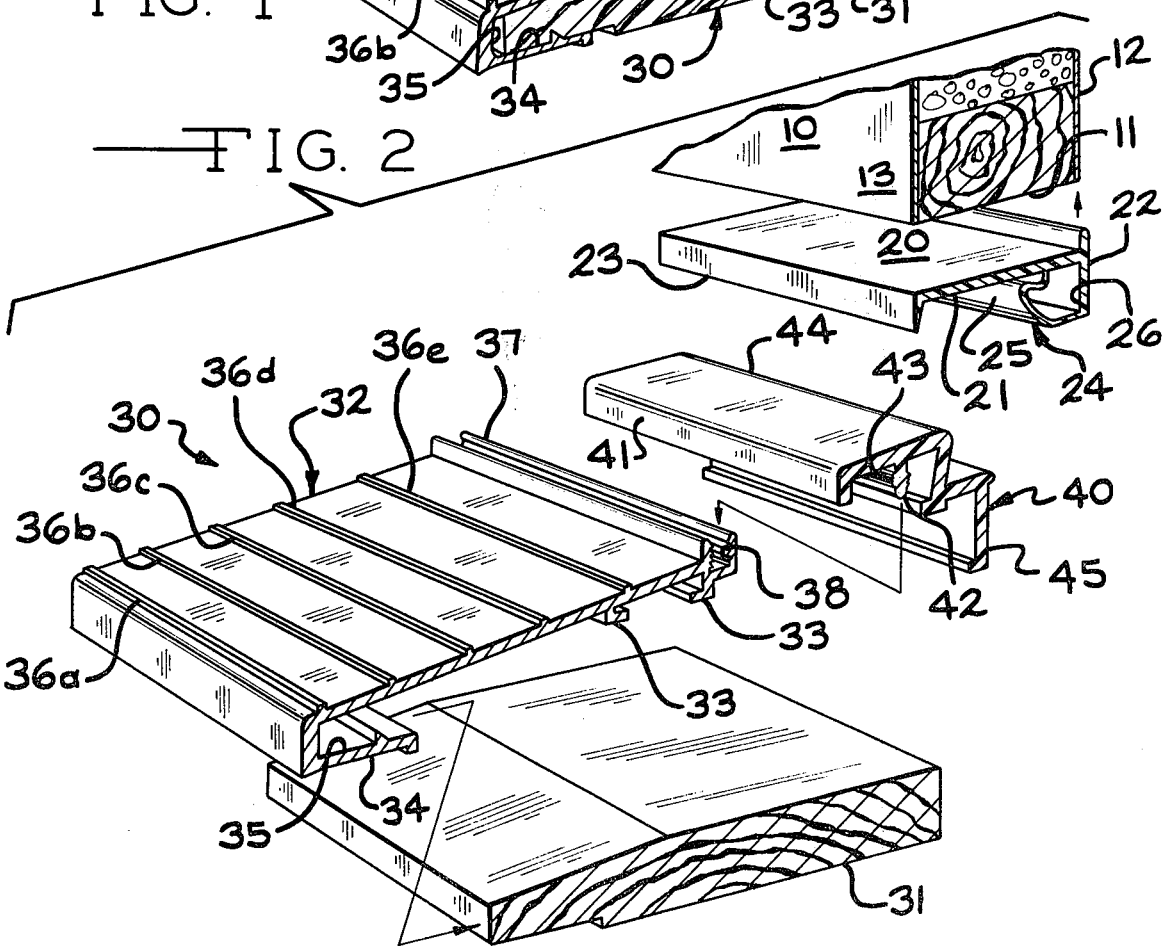
FIG. 2 is a fragmentary exploded view of the various elements of the assembly of the present invention.

The sill assembly 30 in the FIG. 1 embodiment, has a substrate base 31. The substrate base 31, which is normally constructed of wood is mounted beneath the door opening. The substrate base 31 may, of course, be constructed of other materials such as synthetic polymers or composites thereof. Mounted on the substrate base 31 is a weather impervious sill member 32 which is inclined in a downward direction away from the exterior of the door 10. In the preferred embodiment, the weather impervious sill member 32 is constructed of aluminum, however, the sill member 32 may be constructed of steel or other impervious materials such as polycarbonates or other synthetics. Supporting feet 33 are located on the underside of the weather impervious sill 32 and engage the upper surface of the substrate base 31. An inturned lip 34 defines a recess 35 which receives the front end of the substrate base 31. A plurality of spaced ribs **36*a*–36*e* are integrally formed on the upper surface of the sill member 32. The rib 36*a* extends vertically above the upper surface of the sill member 32 a predetermined distance and the ribs 36*b*–36*e* are progressively shorter than such predetermined distance. Rib 36*e* extends the shortest vertical distance above the upper surface of the sill member 32. The sill member 32 defines a channel 37 adjacent the rib 36*e*. The channel 37 has a series of horizontally extending ridges 38** on its interior surface.

In this embodiment, a thermal break member 40 is fixed to the weather impervious sill member 32 so that it will be located directly below the door bottom 11 when the door 10 is in a closed position. The thermal break member 40 is constructed from a vinyl or other non-thermal conductive material. The thermal break member 40 includes a front lip 41 positioned adjacent the upper surface of the sill member 32; a depending leg 42 having mating ridges 43; a horizontally extending projection 44; and a rear wall 45.

Referring to FIG. 1, the channel 37 of the sill member 32 receives the leg 42 of the thermal break member 40.

The mating projection 44 of the thermal break member 40 is positioned adjacent the sealing member 24 of the bottom assembly portion 20. As the door 10 is closed, the mating projection 44 engages the sealing member 24, effectively forming a weather impervious barrier. An important feature of the invention is that so long as the projection 44 engages the sealing member 24 the vertical and horizontal positions of the door bottom 11 relative to the sill assembly 30 may vary. This eliminates labor intensive adjustments in the field without reducing the efficiency of the weather barrier.

In the preferred embodiment, air pockets 46 are located between the weather-impervious sill 32, the substrate base 31 and the thermal break member 40 to assist in achieving the superior insulating characteristics.

Referring to FIGS. 3 and 4 another embodiment of the present invention is shown. In this embodiment, the bottom assembly portion 20 includes a separate sealing member 50 mounted adjacent the flat base 21 and the side 22. The sealing member 50 includes a resilient core 51 constructed of an open cell plastic foam or similar material. The core 51 is surrounded by an impervious outer layer 52 constructed of vinyl or similar material. The sealing member 50 is attached, for example, adhered, to the base 21 and functions in a manner similar to the sealing member 24.

Other types of resilient sealing members (not shown) may also be used. For example, a rubber or rubber-like tube having a flexible sidewall may be utilized. A closed-cell foam, without a cover, may also be utilized.

Figure 5:
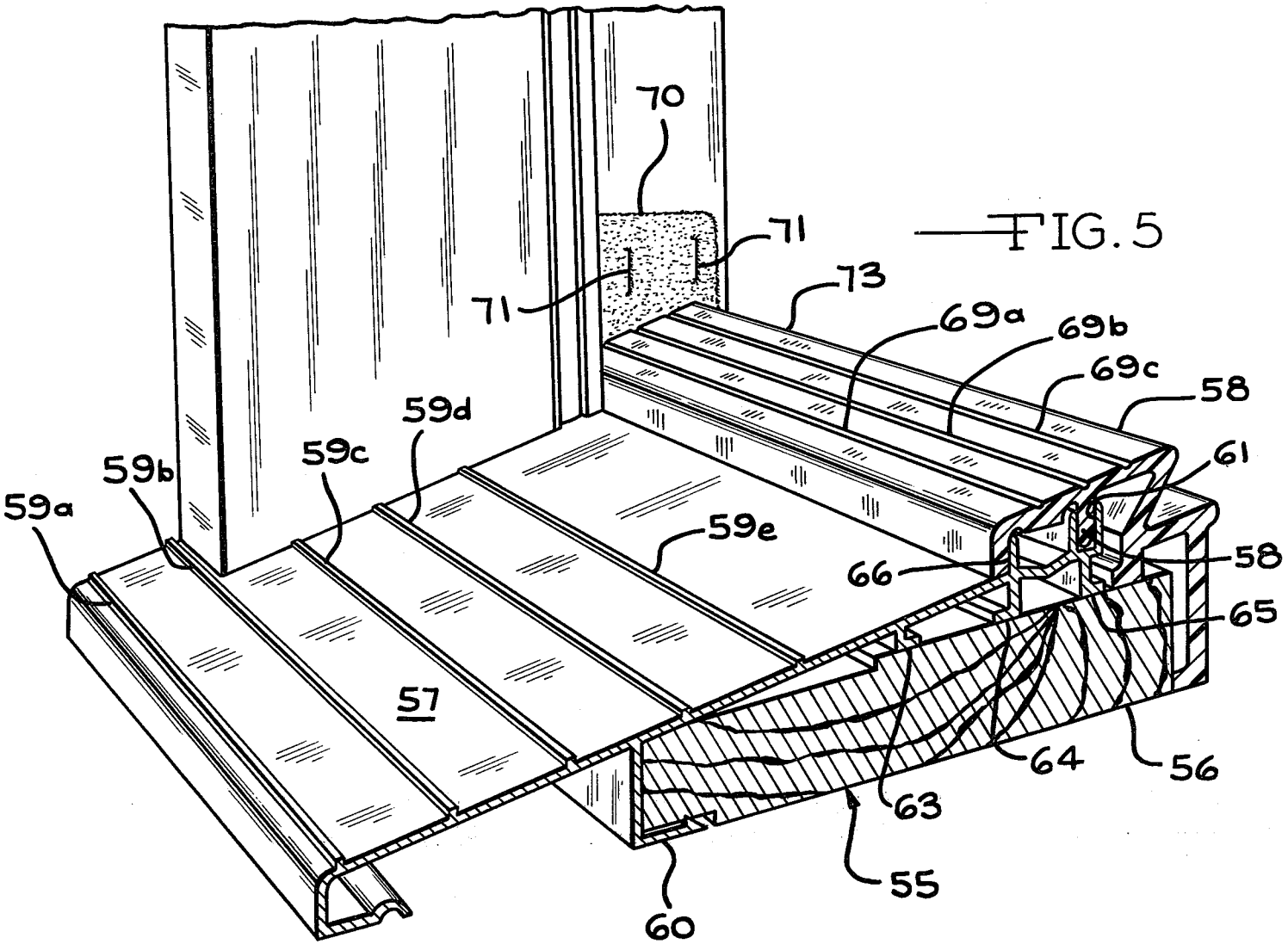
FIG. 5 is a fragmentary perspective view of still another embodiment of an inswing door and sill assembly according to the present invention.

Referring to FIG. 5, still another embodiment of an inswing door and sill assembly is shown. In this embodiment, the inswing door 10 is not shown but has the same construction as the embodiment shown in FIG. 3. Similarly, a bottom assembly 20 is mounted on the bottom of the door 10.

A sill assembly 55 has a substrate base 56, a weather impervious sill member 57 and a thermal break member 58. In the present embodiment, the sill member 57 is constructed of aluminum and includes a plurality of integral ribs 59*a*–59*e*. An inturned lip 60 receives one side of the substrate base 56 while the other side of the base 56 engages the thermal break member 58. The sill member 47 also defines a channel 61 which receives a depending leg 62 of the thermal break member 58. A series of depending supports 63, 64 and 65 which are integral with the sill member 57 engage the upper surface of the substrate base 56.

The impervious sill member 57 also defines an upwardly extending wall 66. The wall 66 acts as a water dam. It has been found that even though the impervious sill member 57 is inclined upwardly, water tends to move, by capillary action or exterior forces, such as wind forces, up the ramped sill and beneath the front edge of the thermal barrier member. The wall 66 stops this movement of water.

In the FIG. 5 embodiment, the thermal break member 58 defines a series of parallel groves 69*a*, 69*b*, and 69*c*. The grove 69*a* serves as an alignment grove. If desired, holes may be drilled along the alignment grove 69*a* through the thermal break member 58, the impervious sill member 57 and the substrate base 56. Screws are then inserted in the holes and fastened directly to the subfloor (not shown). The screws are normally only used where the subflooring does not give a satisfactory mounting surface.

In the present embodiment, a corner seal pad 70 is attached by staples 71 to the door jamb adjacent the thermal break member 58. The corner seal pad 70 compresses upon engagement by the door and seals the lower corner of the overall assembly.

The thermal break member 58 defines a horizontally extending projection 73 which engages the mating flexible side 25 of the sealing member 24, the sealing member 50 or the sealing member 16, whatever type of sealing member unit is placed on the inswing door.

Figure 6:
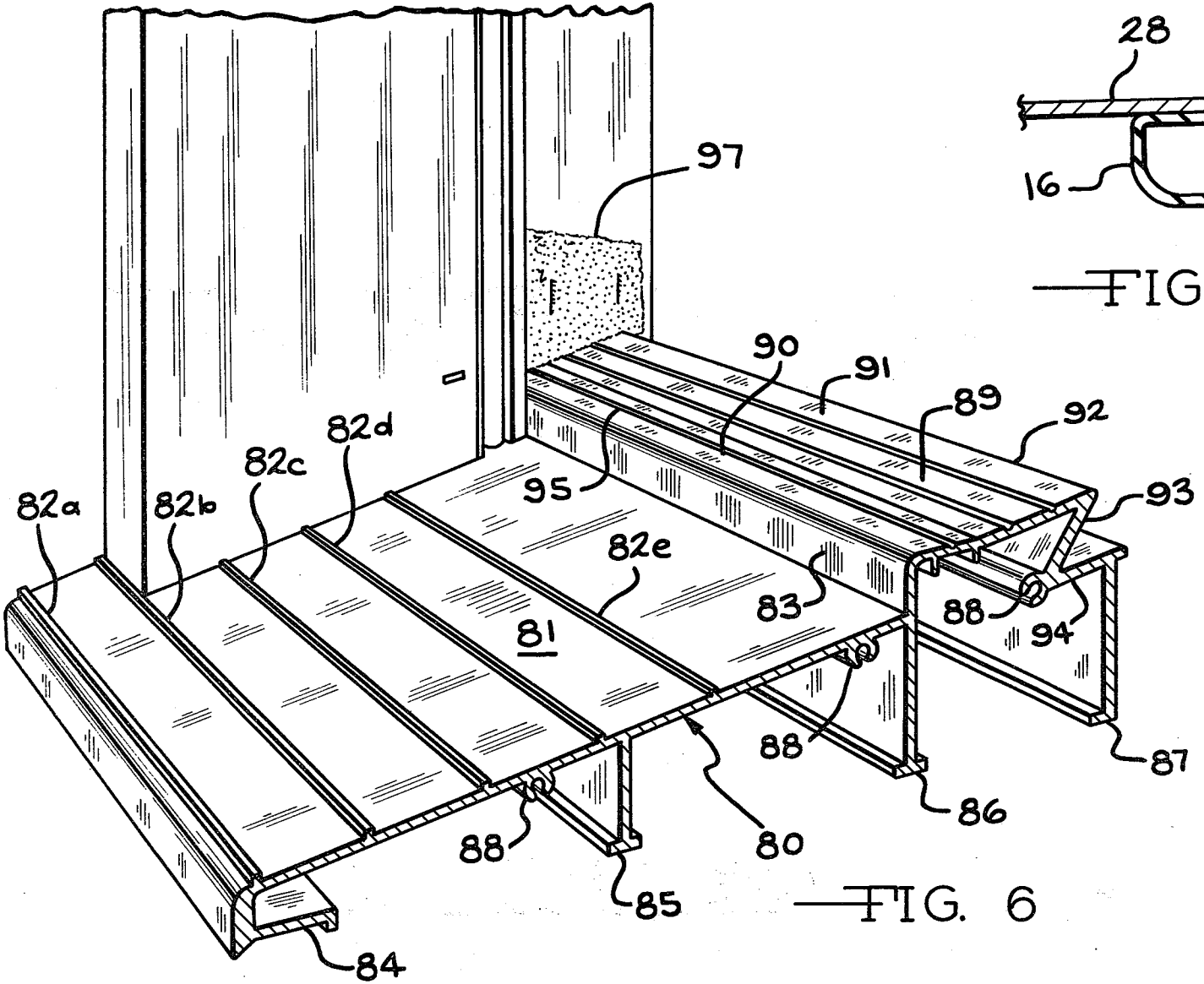
FIG. 6 is a fragmentary perspective view of a moderate climate embodiment of an inswing door and sill assembly according to the present invention.

A moderate climate door bottom and sill assembly 80 is shown in FIG. 6. Again, the inswing door itself is not shown, however, the door bottom assembly is similar to one of the units shown in FIGS. 1, 4 or 7. The moderate climate sill assembly 80 is distinguished over the other embodiments in that it does not include a substrate or a thermal break member. Rather the sill assembly 80 is normally an aluminum extrusion having an upwardly inclined surface 81. A series of ribs 82*a*–82*e* are positioned on the surface 81. The sill assembly includes an integral dam member 83, a series of downwardly extending leg supports 84, 85, 86 and 87, and a plurality of horizontally extending bosses 88. The sill assembly 80 normally abuts against the door frame and screws may be extended through the jamb into an engaging relationship with the bosses 88 to ensure a rigid structure.

The sill assembly 80 also includes a bottom assembly portion 89 which extends inwardly, relative to the door opening, from the dam member 83. The bottom assembly 89 includes an initial flat portion 90 and an upwardly extending ramp portion 91. The ramp portion 91 terminates with a horizontally extending projection 92 which engages the sealing members 24, 50 or 16 located on the bottom of the inswing doors, as previously noted above with respect to the FIGS. 1, 3 and 7 embodiments. Walls 93 and 94 join the horizontally extending projection 92 and the leg 87.

The flat portion 90 of the bottom assembly 89 defines a grove 95 which is utilized as an alignment guide if it is desired to drill holes through the flat portion 90 to engage the moderate climate sill assembly 80 with the subflooring (not shown). This embodiment also includes a corner seal pad 97 which is stapled to the door jamb, sealing the lower portion of the entire door assembly.

It has been found that numerous changes may be made to the improved door bottom and sill assembly for inswing doors, without departing from the spirit and scope of the following claims.

What I claim is:

1. An improved bottom and sill assembly for mounting on exterior doors comprising; a bottom assembly for mounting on such door, said bottom assembly having a flexible and generally tubular sealing member extending along the inner edge of such door and projecting downwardly, said sealing member having a flexible and deflectable exterior wall spaced from an inside wall, a sill assembly positioned below and in mating relationship with said bottom assembly when such door is in a closed position, said sill assembly defining a horizontally extending projection adjacent the inner edge of such door which engages and deflects said sealing member when said door is closed to provide a weather-impervious barrier, said sealing member extending downwardly to an elevation below said horizontally extending projection, said horizontally extending projection deflecting said flexible and deflectable exterior wall inwardly from a first shape to a second shape along the entire horizontally extending projection when the door is closed, whereby a continuous seal is formed and maintained which wraps the horizontally extending projection on both its horizontal and vertical edges even when the door and sill are misaligned.

2. An improved bottom and sill assembly, according to claim 1, including a downwardly extending lip spaced from said sealing member and positioned adjacent the exterior of such door.

3. An improved bottom and sill assembly as described in claim 2, wherein said bottom assembly includes a flat base of substantially the same area and shape as the bottom of such door, said lip being located adjacent one edge of said flat base and said sealing member being located adjacent the other edge of said base.

4. An improved bottom and sill assembly as described in claim 1, wherein said sealing member includes a longitudinally extending compressible foam material.

5. An improved bottom and sill assembly as described in claim 1, wherein said sealing member is removably attached.

6. An improved bottom and sill thermal barrier assembly as described in claim 1, wherein said sill assembly includes an impervious ramp member sloping downwardly toward the exterior and a thermal break member adjacent said ramp, said thermal break member defining said horizontally extending projection.

7. An improved bottom and sill assembly as described in claim 6, wherein said impervious ramp member defines a channel, said thermal break member having a depending leg, wherein said depending leg is received by said channel.

8. An improved door bottom and sill assembly for inswing exterior doors comprising: a bottom assembly for mounting to the bottom of such door, said bottom assembly being integrally comprised of a flat base of substantially the same area and shape as the bottom of such door, a lip mounted adjacent the exterior edge of said base member and projecting downwardly, a generally tubular sealing member mounted adjacent said side wall, said sealing member having a flexible and deflectable exterior wall extending horizontally along the bottom of such door, said sealing member extending downwardly from the bottom of such door, a sill asssembly positioned below such door bottom, said sill assembly including a weather-impervious ramp and a horizontal mating member having horizontal and vertical edges for engaging said flexible and deflectable sealing member thereby providing a weather seal, said flexible sealing member extending downwardly to an elevation below said horizontal mating member, said mating member deflecting said flexible and deflectable exterior wall inwardly from a first shape to a second shape along the entire horizontal mating member when the door is closed, whereby a continuous weather seal is formed which wraps said horizontal mating member on both its horizontal and vertical edges and remains effective even if the door bottom assembly and sill assembly are misaligned with respect to each other.

9. An improved door bottom and sill assembly as described in claim 8, wherein said sill assembly includes a thermal barrier member adjacent said ramp, said thermal barrier member defining said horizontal mating member.

10. An improved door bottom and sill assembly as described in claim 9, including a integral upstanding dam wall on said ramp adjacent said thermal barrier member.

* * * * *